United States Patent [19]

Frey et al.

[11] Patent Number: 4,801,213

[45] Date of Patent: Jan. 31, 1989

[54] INFLATABLE INSERT FOR LUGGAGE

[75] Inventors: Marshall Frey, Ossining; Thomas Scheuer, East Williston, both of N.Y.

[73] Assignee: Airelle Industries, Inc., Ossining, N.Y.

[21] Appl. No.: 113,935

[22] Filed: Oct. 19, 1987

[51] Int. Cl.[4] ..... B65D 30/00

[52] U.S. Cl. ..... 383/3; 229/DIG. 3; 206/522

[58] Field of Search ..... 383/3; 229/DIG. 3; 220/1.5; 190/100, 103, 124; 206/522

[56] References Cited

U.S. PATENT DOCUMENTS

| | | | |
|---|---|---|---|
| 3,889,743 | 6/1975 | Presnick | 206/522 |
| 4,569,082 | 2/1986 | Ainsworth et al. | 206/522 |
| 4,573,202 | 2/1986 | Lee | 206/522 |

*Primary Examiner*—Willis Little

*Attorney, Agent, or Firm*—Salter & Michaelson

[57] ABSTRACT

An inflatable insert is receivable in an item of luggage, such as a suitcase, for protecting fragile articles as they are transported in the item of luggage. The insert includes an inflatable wall portion which is receivable in an item of luggage so that it extends along the inner side of the sidewall thereof and a pocket element on the inner side of the inflatable wall portion for receiving and containing a fragile article in the item of luggage so that it is protected by the inflatable wall portion of the insert. The insert preferably further includes inflatable top and bottom flaps on the upper and lower ends of the inflatable wall portion which are positionable so that they extend inwardly adjacent the upper and lower ends of the pocket element, respectively, for further protecting a fragile article contained in the pocket element.

6 Claims, 3 Drawing Sheets

INFLATABLE INSERT FOR LUGGAGE

BACKGROUND AND SUMMARY OF THE INVENTION

The instant invention relates to luggage and more particularly to an inflatable insert which is receivable in an item of luggage, such as a suitcase, for protecting various fragile articles contained therein, such as bottles containing cosmetics and the like, against breakage.

It has been found that luggage which is transported on mass transit systems is often exposed to relatively rough and abusive treatment. In this regard, it has been found that luggage is often dropped or otherwise jarred as it is passed through baggage handling systems of the type commonly used at mass transit terminals, such as airports and railway stations; and it has been further found that as a result, relatively fragile articles contained in various types of luggage are often broken or otherwise damaged unless they are adequately cushioned and protected. For this reason, various types of "soft" luggage have often been found to be unacceptable for transporting relatively fragile articles on mass transit systems; and it has been found that even relatively heavy impact-resistant luggage must generally be heavily padded in order to protect relatively delicate articles contained therein against breakage.

The instant invention provides an effective solution to the problem of transporting relatively fragile articles, such as bottles or jars containing cosmetics and the like, on mass transit systems. More specifically, the instant invention provides an inflatable insert for an item of luggage, such as a suitcase, which is operative for cushioning and protecting delicate articles contained in the item of luggage. The inflatable insert of the instant invention is operative in combination with an item of luggage of a type including a bottom wall, a peripheral sidewall upstanding from the bottom wall around substantially the entire perimeter thereof, and a top wall which is receivable in a closed position on the sidewall for substantially closing the item of luggage. The insert of the instant invention comprises an inflatable wall portion which is receivable in an item of luggage adjacent the inner side of the sidewall thereof, a pocket element on the inner side of the inflatable wall portion, an inflatable bottom flap portion on the inflatable wall portion adjacent the lower extremity thereof, and an inflatable top flap portion on the inflatable wall portion adjacent the upper extremity thereof. The inflatable bottom flap portion includes at least one inflatable flap which is adapted to be received in a position wherein it extends inwardly between the lower end of the pocket element and the bottom wall of the item of luggage, and the inflatable top flap portion includes at least one inflatable flap which is adapted to be received in a position wherein it extends inwardly between the upper end of the pocket element and the top wall of the item of luggage when the item of luggage is in the closed position thereof. The insert is preferably adapted for use in combination with a suitcase of substantially rectangular configuration having spaced, substantially parallel front and rear walls which are joined by a pair of spaced, substantially parallel end walls; and the inflatable wall portion of the insert preferably comprises front and rear portions which extend along the inner sides of the front and rear walls of the suitcase, respectively, and a pair of end portions which extend along the inner sides of the end walls of the suitcase and join the front and rear portions of the insert at the ends thereof. The inflatable insert preferably further comprises a plurality of pocket elements which are detachably mounted on the front, rear, and the end portions of the inflatable wall portion; and the top and bottom flap portions preferably each comprise a plurality of inflatable flaps which are attached to the front, rear and end wall portions, adjacent the upper and lower ends thereof, respectively.

It has been found that the inflatable insert of the instant invention can be effectively utilized for protecting relatively fragile articles, such as bottles containing cosmetics and the like, as they are transported on mass transit systems. Specifically, the insert is receivable in an item of luggage, such as a suitcase, so that it is operative for protecting relatively fragile articles as they are transported in the item of luggage. In this connection, the pocket elements of the insert are adapted for receiving relatively fragile articles therein so that they are positioned adjacent the inflatable wall portion of the insert and so that the upper and lower extremities of the articles are protected by the adjacent inflatable top and bottom flaps. As a result, the articles are well protected and cushioned against breakage; although, there is nevertheless a substantial amount of interior space in the item of luggage for transporting other items, such as articles of clothing. In this connection, it has been found that because of the manner in which the inflatable insert is operative for protecting relatively fragile articles against breakage, it can be effectively utilized in combination with relatively light-weight soft luggage as well as rigid impact-resistant luggage for effectively protecting relatively fragile articles as they are transported.

Articles of luggage and other items representing the closest prior art to the instant invention of which the applicants are aware are disclosed in the U.S. Pat. Nos. to CART, 2,542,477; MATTEL, 3,587,794; PRESNICK, 3,889,743; FISHER, 4,044,867; KOVINS, 4,215,778 and AINSWORTH et al, 4,569,082; the German patent to HOHNS, No. 2 218 759; and the French patent to THEBAULT, No. 77 09359. However, since these references fail to disclose or suggest the concept of providing an inflatable insert including an inflatable wall portion, a pocket element on the wall portion, and inflatable top and bottom flaps which are operative for cushioning the upper and lower portions of an article contained in the pocket element, they are believed to be of only general interest with respect to the subject invention.

As a result of the above, it is a primary object of the instant invention to provide an effective inflatable insert which is receivable in an item of luggage, such as a suitcase, for protecting fragile articles contained therein.

Another object of the instant invention is to provide an inflatable insert including an inflatable wall portion, a pocket element on the inner side of the wall portion and inflatable top and bottom flaps which are attached to the inflatable wall portion adjacent the upper and lower ends thereof, respectively.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
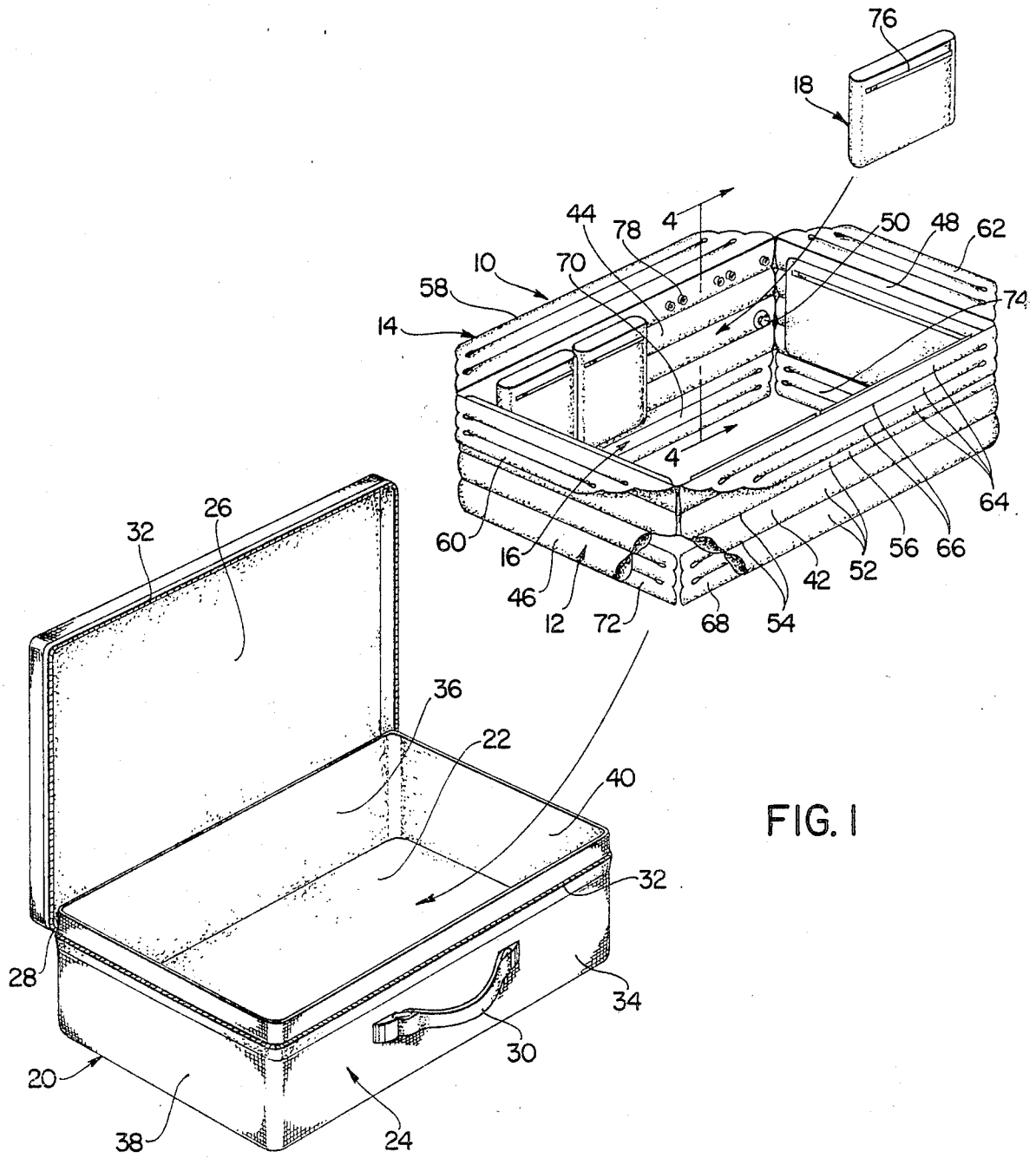
FIG. 1 is a partially exploded perspective view of the insert of the instant invention in combination with a suitcase.

Referring now to the drawings, the inflatable insert of the instant invention is illustrated and generally indicated at 10 in FIGS. 1-4. The insert 10 comprises an inflatable wall portion generally indicated at 12, an inflatable top flap portion generally indicated at 14, an inflatable bottom flap portion generally indicated at 16, and a plurality of pocket elements generally indicated at 18. The insert 10 is adapted for use in combination with an item of luggage, such as the suitcase illustrated in FIGS. 1-3 and generally indicated at 20, and it is operative for cushioning and protecting articles contained in the pocket elements 18 in order to prevent breakage thereof during transportation of the articles in the suitcase 20.

The suitcase 20 is of conventional construction, and it includes a bottom wall 22, a peripheral sidewall generally indicated at 24 which extends upwardly from the bottom wall 22, and a top wall 26 which is hingeably attached to the sidewall 24 along a hinge line 28. The suitcase 20 further comprises a conventional handle 30 on the sidewall 24, and a zipper 32 which is operative for securing the top wall 26 in a closed position on the sidewall 24 in order to close the suitcase 20 in a conventional manner. The top and bottom walls 22 and 26 are preferably of substantially rectangular configuration; and the sidewall 24 includes spaced, substantially parallel front and rear walls 34 and 36, respectively, and a pair of spaced, substantially parallel end walls 38 and 40 which join the front and rear walls 34 and 36, respectively, at the ends thereof. In the suitcase 20 as herein embodied, the bottom wall 22, the sidewall 24 and the top wall 26 are constructed from a relatively heavy canvass-like material; and hence the walls of the suitcase 20 are actually somewhat flexible. It will be understood, however, that the insert 10 can also be effectively utilized with impact resistant luggage having substantially rigid walls and that the insert of the instant invention can also be effectively adapted for use in combination with luggage of various different configurations.

Referring now more specifically to the insert 10, the wall portion 12 is adapted to be received in the suitcase 20 so that it extends along the inner side of the sidewall portion 24, and it includes front and rear portions 42 and 44, respectively, which are joined at the ends thereof by end portions 46 and 48. The front, rear and end portions 42, 44, and 46 and 48, respectively, are of substantially the same dimension and configuration as the front, rear and end walls 34, 36, and 38 and 40, respectively, of the suitcase 20, and the wall portion 12 is adapted to be received in the suitcase 20 so that the front, rear and end portions 42, 44, and 46 and 48, respectively, are positioned along the inner sides of their respective walls of the suitcase 20. The wall portion 12 is preferably formed from a suitable inflatable, substantially air-tight rubberized material, such as vinyl; and an inflation nipple 50 is provided on the inner side of the rear portion 44 for inflating the insert 12. The front, rear, and end portions 42, 44, and 46 and 48, respectively, of the wall portion 12 each include a plurality of inflatable segments 52 which are separated by seams 54 for preventing the wall portion 12 from bulging excessively inwardly into the interior of the suitcase 20 when it is inflated; although the segments 52 are all internally interconnected to enable the entire wall portion 12 to be inflated at one time via the inflation nipple 50.

Figure 2:
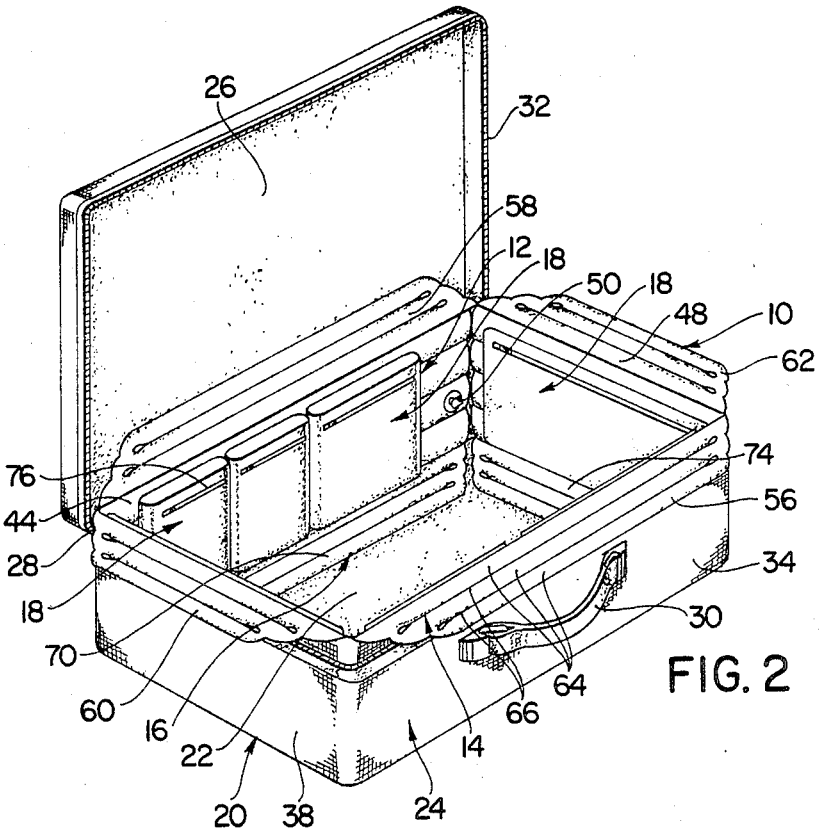
FIG. 2 is a perspective view thereof with the insert assembled in the suitcase and with the top flaps of the insert in the open positions thereof.
Figure 3:
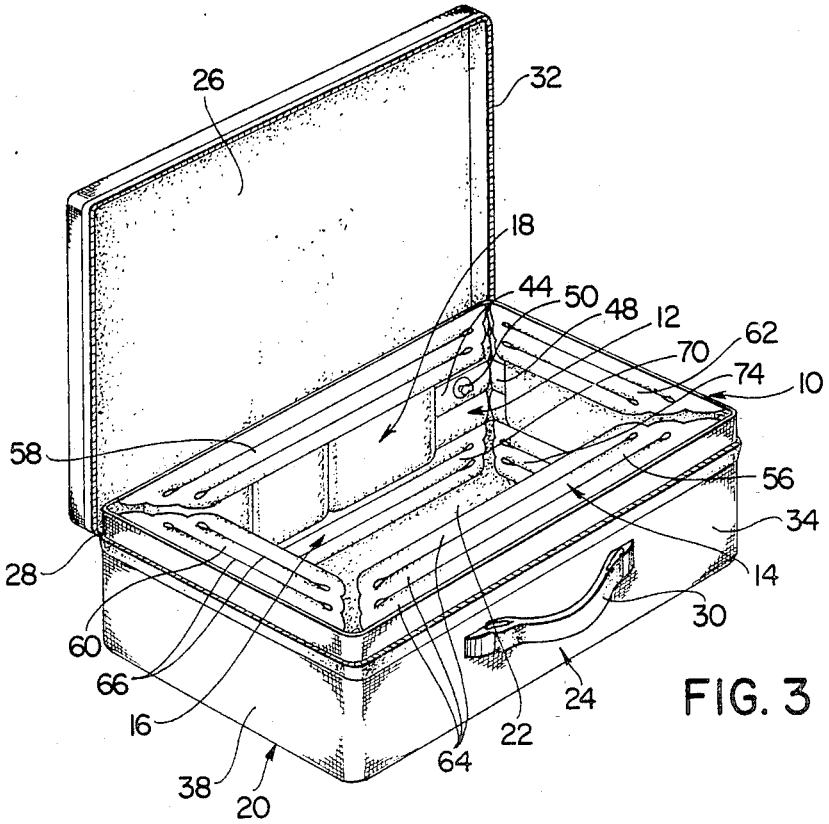
FIG. 3 is a similar view with the top flaps in the closed positions thereof.
Figure 4:
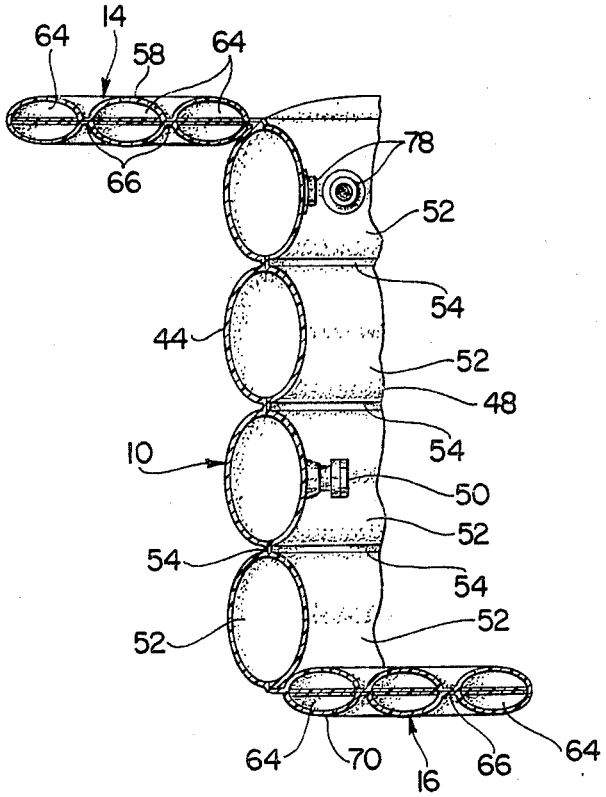
FIG. 4 is a sectional view taken along line 4—4 in FIG. 1.

The top flap portion 14 comprises front and rear top flaps 56 and 58, respectively, which are hingeably connected to the front and rear portions 42 and 44, respectively, adjacent the upper ends thereof and a pair of end top flaps 60 and 62 which are hingeably connected to the end portions 46 and 48, respectively, adjacent the upper ends thereof. The top flaps 56, 58, 60 and 62 are preferably integrally formed with the wall portion 12, and they preferably each include a plurality of inflatable segments 64 which are separated by seams 66; although the segments 64 preferably communicate with the wall portion 12 so that the top flaps 56, 58 and 60 and 62 are inflated as the wall portion 12 is inflated. The top flaps 56, 58, 60 and 62 extend along substantially the entire upper edges of their respective portions of the wall portion 12, and they are adapted to be hingeably moved between the outwardly extending open position illustrated in FIG. 2 and the closed position illustrated in FIG. 3. wherein they extend inwardly into the suitcase 20 above the upper ends of the adjacent pocket elements 18. As illustrated in FIGS. 1, 2, and 3, the opposite ends of the top flaps 56, 58, 60 and 62 are disposed at acute angles of approximately 45° to enable adjacent top flaps to be folded inwardly without overlapping each other.

The bottom flap portion 16 comprises front and rear bottom flaps 68 and 70 and a pair of end bottom flaps 72 and 74, which are hingeably attached to the front, rear and end portions 42, 44 and 46 and 48, respectively, of the sidewall portion 12 adjacent the lower ends thereof. The bottom flaps 68, 70, 72 and 74 are substantially identical to the top flaps 56, 58, 60 and 62, respectively, and they are adapted so that they communicate with the sidewall portion 12 for inflating the bottom flaps 68, 70, 72 and 74 through the nipple 50. The bottom flaps 68, 70, 72 and 74 are hingeably attached to their respective portions of the sidewall portion 12 so that they are alternatively hingeable outwardly or inwardly with respect thereto; although they are normally maintained in inwardly hinged positions when the insert 10 is received in the suitcase 20 in the manner illustrated in FIGS. 2 and 3. The opposite ends of the bottom flaps 68, 70, 72 and 74 are also preferably disposed at angles of approximately 45° to permit the bottom flaps to be folded inwardly without overlapping each other.

The pocket elements 18 comprise envelope or pocket-like structures, and they are preferably constructed from a suitable vinyl or rubberized material in substantially leak-proof constructions. The pocket elements 18 preferably include zipper-type closure members 76, and they are preferably adapted to be releasably secured to the sidewall portion 12 with suitable releasable fastening elements, such as plastic snaps 78.

During use, the insert 10 is assembled in the suitcase 20 in the manner illustrated in FIG. 2 so that the front and rear portions 42 and 44, respectively, are positioned adjacent the inner sides of the front and rear walls 34 and 36, respectively, and so that the end portions 46 and 48 are positioned adjacent the inner sides of the end walls 38 and 40. The bottom flaps 68, 70, 72 and 74 are normally positioned so that they extend inwardly along the inner side of the bottom wall 22 beneath the lower ends of the pocket elements 18. The top flaps 56, 58, 60 and 62, on the other hand, are alternatively positionable in the open positions thereof illustrated in FIG. 2, wherein they extend outwardly from the wall portion 12 to provide free access to the pocket elements 18 or the closed positions thereof illustrated in FIG. 3. When the top flaps 56, 58, and 60 and 62 are in the open positions thereof, the zipper elements 76 can be manipulated between the open and closed positions thereof; and various fragile or delicate articles, such as bottles containing cosmetics and the like, can be placed in the pocket elements 18. Further, various garments or other articles can be placed in the interior area of the suitcase 20 defined by the insert 10. In any event, after the suitcase 20 has been fully packed, and the top flaps 56, 58, 60 and 62 have been moved to the closed positions thereof illustrated in FIG. 3, the top wall 26 of the suitcase 20 can be moved to the closed position thereof and secured with the zipper 32.

It is seen therefore that the instant invention provides an effective inflatable insert for use in combination with a suitcase. In this regard, when the insert 10 is assembled in an item of luggage, such as the suitcase 20, and the pocket elements 18 and the suitcase 20 are properly packed in the above-described manner, the articles contained in the pocket elements 18 are protected by the inflatable wall portion 12 and the inflatable top and bottom flap portions 14 and 16, respectively. Specifically, the inflatable wall portion 12 protects the articles contained in the pocket elements 18 against impacts from the sides of the suitcase 20, whereas the top and bottom flap portions 14 and 16, respectively, protect the articles contained in the pocket elements 18 against impacts from the top and bottom of the suitcase 20, respectively. However, because of its overall construction, the insert 10 does not occupy a substantial amount of space in the interior of the suitcase 20 so that the suitcase 20 can nevertheless be utilized for effectively transporting a normal amount of garments or other articles. Accordingly, it is seen that the insert of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An inflatable insert for an item of luggage, said item of luggage being of a type including a bottom wall, spaced substantially parallel front and rear walls extending upwardly from said bottom wall, a pair of spaced substantially parallel end walls extending upwardly from said bottom wall and joining said front and rear walls, and a top wall receivable in a closed position on said front, rear and end walls for substantially closing said suitcase, said insert comprising an inflatable wall portion which is receivable in said item of luggage, said wall portion including inflatable front and rear portions which extend along the inner sides of the front and rear walls of said item of luggage when said insert is received therein and a pair of inflatable end portions which extend between said front and rear portions and along the inner sides of the end walls of said item of luggage when said insert is received therein, an inflatable bottom flap hingeably attached to said wall portion and extending inwardly along the inner side of said bottom wall of said item of luggage when said insert is received therein, and a plurality of inflatable top flaps, one of said top flaps being hingeably attached to each of said front, rear, and end portions of said insert, said top flaps being positionable so that they extend inwardly in said item of luggage, and at least one pocket element secured on the inner side of said wall portion so that it is positioned between said bottom flap and one of said top flaps when said top and bottom flaps are inwardly hinged positions.

2. The inflatable insert of claim 1 further comprising a plurality of said bottom flaps, one of said bottom flaps being hingeably attached to each of the front, rear and end portions of said insert and extending inwardly along the inner side of said bottom wall of said item of luggage when said insert is received therein.

3. In the inflatable insert of claim 2, said top flaps and said bottom flaps each including a plurality of inflatable segments.

4. In the inflatable insert of claim 2, the front, rear and end portions of said inflatable wall portion each including a plurality of inflatable segments.

5. In the inflatable insert of claim 2, said top and bottom flaps extending along substantially the entire extents of the portions of said wall portion to which they are hingeably attached, the opposite ends of said top and bottom flaps being disposed at acute angles which permit adjacent top flaps and adjacent bottom flaps to be positioned in inwardly extending nonoverlapping relation.

6. In the inflatable insert of claim 5, the opposite ends of said flaps being disposed at angles of approximately 45°.

* * * * *